US009788624B2

(12) United States Patent
Weatherly et al.

(10) Patent No.: US 9,788,624 B2
(45) Date of Patent: Oct. 17, 2017

(54) HAIR STYLING APPARATUS

(71) Applicant: JEMELLA LIMITED, Leeds (GB)

(72) Inventors: Robert Alexander Weatherly, Cambridgeshire (GB); Daniel Brady, Berkshire (GB); Steve Sayers, Buckinghamshire (GB); Mark Andrew Gagiano, Piara Waters (AU); Timothy David Moore, Hertfordshire (GB); Jeremy Peter Clements, Cambridgeshire (GB); Paul Scott, Cambridgeshire (GB); James Baker, Cambridgeshire (GB)

(73) Assignee: JEMELLA LIMITED, Leeds (GB)

( * ) Notice: Subject to any disclaimer, the term of this patent is extended or adjusted under 35 U.S.C. 154(b) by 0 days.

(21) Appl. No.: 14/370,408

(22) PCT Filed: Jan. 10, 2013

(86) PCT No.: PCT/GB2013/050036
§ 371 (c)(1),
(2) Date: Jul. 2, 2014

(87) PCT Pub. No.: WO2013/104903
PCT Pub. Date: Jul. 18, 2013

(65) Prior Publication Data

US 2014/0338691 A1 Nov. 20, 2014

(30) Foreign Application Priority Data

Jan. 10, 2012 (GB) ..... 1200337.2
Aug. 21, 2012 (GB) ..... 1214875.5

(51) Int. Cl.
*A45D 1/02* (2006.01)
*A45D 1/04* (2006.01)
(Continued)

(52) U.S. Cl.
CPC ..... *A45D 1/02* (2013.01); *A45D 1/04* (2013.01); *A45D 2/001* (2013.01); *A45D 1/28* (2013.01)

(58) Field of Classification Search
CPC ... A45D 1/00; A45D 1/04; A45D 1/06; A45D 1/10; A45D 1/14; A45D 1/28;
(Continued)

(56) References Cited

U.S. PATENT DOCUMENTS 1,691,115 A * 11/1928 Jacobs ..... 132/232
1,731,522 A * 10/1929 Carlson ..... 132/224
(Continued)

FOREIGN PATENT DOCUMENTS

CN 202750913 U 2/2013
DE 3215232 A1 10/1983
(Continued)

OTHER PUBLICATIONS

British Search Report for corresponding application GB1319940.1; Report dated May 9, 2014.
(Continued)

*Primary Examiner* — Todd E Manahan
*Assistant Examiner* — Jennifer Gill
(74) *Attorney, Agent, or Firm* — Cantor Colburn LLP

(57) ABSTRACT

A hair styling apparatus including a first and a second arm moveable between a closed position in which a contacting surface of the first arm is adjacent a contacting surface of the second arm and an open position in which the contacting surfaces of each arm are spaced apart, whereby the contacting surfaces of each arm have complementary profiles so that, in use, a section of hair is clamped between the contacting surfaces when the arms are in the closed position, and where a heating zone on at least one of the contacting surfaces is provided to heat the section of hair between the
(Continued)

contacting surfaces, a cooling zone on at least one of the contacting surfaces is provided for cooling the section of hair after the section of hair has been heated, and the cooling zone is curved whereby, in use, as the hair styling apparatus is moved along the section of hair in a generally linear fashion, the section of hair is curled.

19 Claims, 8 Drawing Sheets

(51) Int. Cl.
*A45D 2/00* (2006.01)
*A45D 1/28* (2006.01)

(58) Field of Classification Search
CPC .... A45D 2/001; A45D 2/40; A45D 2200/202; A45D 2200/205
USPC ..... 132/218, 224, 228
See application file for complete search history.

(56) References Cited

U.S. PATENT DOCUMENTS

| | | | | |
|---|---|---|---|---|
| 4,819,674 | A * | 4/1989 | Takimae | 132/224 |
| 4,917,078 | A * | 4/1990 | Zaborowski | 126/409 |
| 5,120,933 | A * | 6/1992 | Altamore et al. | 219/225 |
| 5,357,988 | A * | 10/1994 | Nakamura | 132/232 |
| 5,799,671 | A * | 9/1998 | Takimae | 132/225 |
| RE38,713 | E * | 3/2005 | Habibi | 132/224 |
| D606,251 | S * | 12/2009 | Leung | D28/35 |
| D606,252 | S | 12/2009 | Leung | |
| 8,013,274 | B2 * | 9/2011 | Suzuki et al. | 219/225 |
| 9,173,465 | B2 | 11/2015 | Morgandi | |
| 2006/0037625 | A1 * | 2/2006 | Kayser et al. | 132/224 |
| 2006/0201527 | A1 * | 9/2006 | Higgins et al. | 132/225 |
| 2008/0257372 | A1 * | 10/2008 | Mills et al. | 132/224 |
| 2009/0260650 | A1 * | 10/2009 | Jung | 132/224 |
| 2010/0086577 | A1 * | 4/2010 | Munoz et al. | 424/405 |
| 2010/0101599 | A1 * | 4/2010 | Choi | 132/269 |
| 2010/0132733 | A1 * | 6/2010 | Kyu et al. | 132/229 |
| 2010/0154817 | A1 | 6/2010 | Lee | |
| 2011/0056509 | A1 | 3/2011 | Benest et al. | |
| 2011/0108052 | A1 * | 5/2011 | Morgandi | A45D 1/04 132/230 |
| 2011/0232673 | A1 * | 9/2011 | Crawford | 132/232 |
| 2011/0253164 | A1 | 10/2011 | Morgandi et al. | |
| 2012/0111354 | A1 * | 5/2012 | Cafaro et al. | 132/211 |
| 2012/0312320 | A1 | 12/2012 | Humpfreys | |
| 2014/0238432 | A1 * | 8/2014 | Deng | 132/211 |
| 2015/0122284 | A1 * | 5/2015 | Smith | 132/211 |

FOREIGN PATENT DOCUMENTS

| | | | |
|---|---|---|---|
| DE | 19748067 | | 5/1999 |
| DE | E102010061907 | | 5/2012 |
| DE | 102010062715 | | 6/2012 |
| EP | 0448778 | A2 | 10/1991 |
| EP | 2745728 | A1 | 6/2014 |
| GB | 1200337 | A | 7/1970 |
| GB | 1214875 | A | 12/1970 |
| GB | 2312840 | A | 11/1997 |
| GB | 2459507 | | 10/2009 |
| GB | 2477834 | | 8/2011 |
| GB | 2498417 | A | 7/2013 |
| JP | 2004230180 | A | 8/2004 |
| JP | 2008119471 | A | 5/2008 |
| JP | 2011104360 | A | 6/2011 |
| KR | 100953446 | | 4/2010 |
| KR | 100959792 | | 5/2010 |
| KR | 2020100005327 | U | 5/2010 |
| KR | 20120019693 | A | 3/2012 |
| WO | 2005067760 | | 7/2005 |
| WO | 2006099522 | | 9/2006 |
| WO | 2007000700 | | 1/2007 |
| WO | 2008032978 | | 3/2008 |
| WO | 2008062293 | | 5/2008 |
| WO | 2009074788 | A2 | 6/2009 |
| WO | 2013013965 | | 1/2013 |
| WO | 2013104903 | A2 | 7/2013 |

OTHER PUBLICATIONS

British Search Report for corresponding application GB1311595.1; Report dated Dec. 12, 2013.
International Search Report for corresponding application PCT/GB2013/050036 filed Jan. 10, 2013; dated Aug. 8, 2013.
Written Opinion for corresponding application PCT/GB2013/050036 filed Jan. 10, 2013; dated Aug. 8, 2013.
International Preliminary Report on Patentability for corresponding application PCT/GB2013/050036 filed Jan. 10, 2013; Report dated Jul. 15, 2014.
British Search Report for corresponding application GB1319940. 1; Report dated Nov. 7, 2014.
CN Office Action dated Dec. 5, 2016 re: Application No. 2014-551672; pp. 1-5; citing: JP 2004-230180, JP 2008-119471, JP 2011-104360, U.S. Pat. No. 1,731,522, U.S. 2011/0056509.
International Seach Report for corresponding application PCT/GB2014/053349 filed Nov. 12, 2014; dated Feb. 26, 2015.
Japanese office action for corresponding application 2014-551672; Report dated Dec. 5, 2016.
Russian Office Action for corresponding application 2014132880/12(052935) filed Jan. 10, 2013; Report dated Feb. 1, 2017.
British Examination Report for corresponding application GB1214875.5; dated Feb. 7, 2013.
British Search Report for corresponding application GB1200337.2; dated May 10, 2012.
British Search Report for corresponding application GB1214875.5; dated Nov. 5, 2012.
New Zealand Examination Report for corresponding application 628020; Report dated Nov. 25, 2014.

* cited by examiner

HAIR STYLING APPARATUS

FIELD OF INVENTION

The invention relates to hair styling apparatus, particularly those for curling hair.

BACKGROUND TO THE INVENTION

There are a variety of hair styling apparatus for curling and straightening hair. One such apparatus is known as an air brush or air styler. Such a styler generates a heated airflow which is delivered into the hair to create style (and/or volume). In some stylers, the heated airflow is delivered under pressure. Typically air brushes do not create a style quickly and easily. This is because the air temperature is too low (only 110° C.) to create style quickly. Furthermore, heat is not effectively delivered into the hair. Even for the products where the airflow is pressurised, the air pressure is too low to push the air through the hair and hence deliver the heat into the hair. The result is that the airflow tends to find an "easier" route which is not through the hair. The performance could be improved by increasing the pressure and temperature, e.g. by delivering the airflow though small holes.

Another apparatus for curling is known as a wand or tong. This comprises a heated generally cylindrical barrel. A hair section is wrapped around the barrel and the apparatus delivers heat from the surface of the barrel through the hair section. However, the heat transfer takes time and is very inefficient way of transferring the heat to the hair (hair is a thermal insulator). It is known to improve the thermal response by using ceramic heaters in the barrel. However, this does not address the inefficient method of transferring heat to the hair.

Ceramic heaters are also used in hair straightening devices. The inefficient method of transferring heat to the hair is addressed in such devices by providing two heating plates and placing the hair between the plates (e.g. GB2477834 to the present applicant which is incorporated by reference). This is a very efficient way of transferring the heat into the hair and provides a fast thermal response. Moreover, such stylers typically deliver longevity of style because of the effectiveness of transferring heat into and through the whole section of the hair. It is possible to use such hair straightening devices to curl hair by turning the hair straightener through 180°. However, care needs to be taken regarding the direction of the turn to create curls curling in the same direction.

WO2008/062293 describes a hair straightener comprising a pair of flat heated hair styling surfaces and a cooling arrangement adjacent the styling surfaces to remove heat from the just-styled hair. Similarly, WO2007/000700 describes a straightener having a heating member and a cooling member. In both cases, the hair is cooled by after exiting from the heating member to prevent damage to the hair and to provide a longer lasting style.

Other examples and techniques can be found in DE102010062715, KR100953446, DE102010061907, KR100959792, DE19748067, GB2459507, US2010/0154817 and WO2008/062293.

The applicant has recognised the need for an improved apparatus which offers a quick and easy way to curl hair and also produces long lasting curls.

STATEMENTS OF INVENTION

According to a first aspect of the invention, there is provided a hair styling apparatus comprising a first and a second arm moveable between a closed position in which a contacting surface of the first arm is adjacent a contacting surface of the second arm and an open position in which the contacting surfaces of each arm are spaced apart, whereby the contacting surfaces of each arm have complementary profiles so that, in use, a section of hair is clamped between the contacting surfaces when the arms are in the closed position; a heating zone on at least one of the contacting surfaces for heating the section of hair between the contacting surfaces and a cooling zone on at least one of the contacting surfaces for cooling the section of hair after the section of hair has been heated, wherein the cooling zone is curved whereby, in use, as the hair styling apparatus is moved along the section of hair in a generally linear fashion, the section of hair is curled.

Such apparatus is simple to use. The pair of arms are opened and a section of hair placed between the arms which are then closed. The apparatus is then pulled across the hair to create a curl in a similar manner to that in which a hair straightener straightens hair. The motion is linear. In some arrangements no twisting of the hair around the apparatus may be necessary nor may twisting the apparatus relative to the head be necessary. In some variants however, the apparatus may be turned up to 90 degrees relative to the head when in use.

The cooling zone is preferably immediately adjacent the heating zone whereby the hair is cooled at its hottest point. The cooling zones are termed as such as, in use, they are at a lower temperature than the heating zone. The present applicant has recognised that this is the most effective place to cool the hair to retain its shape. Furthermore, the curvature of the cooling zone may be at its greatest immediately adjacent the heating zone. Again this improves curling.

The heating zone may heat the hair to at least 160° C. The cooling zone may cool the hair to between 90° C. and 160° C.

The cooling zone may be further arranged to heat the hair to a temperature less than the heating zone heats the hair to. In arrangements where hair is heated to at least 160° C., the heating in the cooling zone may then be to a lower temperature, preferably to heat hair to between 90 and 160° C., more preferably to heat/cool hair in the cooling zone to approximately 90° C. The temperature of the cooling zone may be regulated to a constant temperature which may be particularly useful when the styling apparatus is first turned on to raise the temperature of the cooling zone to a regulated operating temperature. This may provide for more consistent styling.

Each of the contacting surfaces may comprise a heating zone which are aligned so that the heating zones are adjacent when the arms are in the closed position. In this way, the section of hair is in direct contact with two heating zones which improves heat transfer. The or each heating zone may be a heatable plate in thermal contact with a heater in the hair styling apparatus.

Each of the contacting surfaces may comprise a cooling zone which are aligned so that the cooling zones are adjacent when the arms are in the closed position. In this way the section of hair is in direct contact with two cooling zones.

The or each cooling zone may be conductive, for example by using a conductive plate or member. Such a conductive plate may have sufficient surface area to dissipate the heat built up to the environment in-between uses/strokes. Alternatively, said conductive plate may be used in conjunction with a fluid cooling system. The fluid (e.g. air) may be used to cool the conductive surface in between uses. Such a conductive member may be a metal rod or a formation machined or cast from metal for example.

Alternatively, the or each cooling zone may be provided by a fluid cooling system alone. In other arrangements a fluid cooling system may be used in combination with conduction (such as with a conductive plate or member).

The fluid may be delivered to the cooling zone at high pressure. The pressure and/or volume of fluid flow may be regulated to improve curling.

The fluid cooling system may comprise a fan arranged to deliver an air flow to the or each cooling zone. The fan may preferably be housed in the body of the apparatus with conduits through the body to one or both of the arms.

The cooling zone may comprise one or more conduits, which may be through a conductive plate or member for example for moving the fluid. These conduits may be used for actively cooling. The conduits may be routed through the conductive plate or member so as to cool the plate or member.

It is important to ensure good thermal contact with the hair. Accordingly, each contacting surface may be supported on a resilient suspension to allow some movement of each contacting surface relative to its arm. This improves the contact between the hair and the contacting surfaces.

At least one of the or each cooling zone may further comprise a guide member positioned to guide the cooled section of hair away from the heating zone and cooling zone. In use the hair styling apparatus may be held at an angle to the head such that hair is turned through 90 degrees on exiting the cooling zone such that styled hair is turned in the reverse direction to its path through the cooling zone. To minimise any further cooling as the hair is turned in this reverse direction, which may damage the hair style, the guide members may be formed from a material of poor thermal conductivity to minimise cooling. Such material may be that of the apparatus housing (rynite for example).

Each of the cooling zones may comprise a said guide member. In such an arrangement one of the guide members may be convex and the other may have a matching concave shape such that both guide members fit together snugly. Guide members may also be present in both cooling zones either side of the heating zone.

Each arm may be generally elongate and the heating zone extends along at least part or most of the length of at least one of the arms. Similarly, the cooling zone may extend along at least part, or most, of the length of at least one of the arms.

For curling, it is critical that the hair is heated before it is cooled in the curved cooling zone. One arrangement of the apparatus may comprise a single cooling area and a single heating area. The cooling area may comprise a cooling zone on one or both of the contacting surfaces. Similarly, the heating area may comprise a heating zone on one or both of the contacting surfaces. In such apparatus, the user must ensure that the apparatus is moved relative hair in the correct direction to ensure that curling occurs.

As an alternative, the apparatus may comprise two cooling areas for cooling the section of hair after the section of hair has been heated, the cooling areas being positioned either side of the heating zone. The cooling areas may comprise a cooling zone on one or both of the contacting surfaces. In such apparatus, the hair will always be cooled after it has been heated and thus the direction of use is not critical. It may be termed ambidextrous. Where the arms are elongate, the two cooling zones may both extend along at least part, or most, of the length of at least one of the arms and are positioned either side of the heating zone.

The apparatus may further comprise heat transfer means arranged to thermally link the two cooling zones so as to transfer heat absorbed from heated hair between both cooling zones. The heat transfer means may provide a thermal coupling between the cooling zones either side of the heating zone such that heat may be transferred from one cooling zone to the other. The heat transfer means may comprise a conductive plate or heat pipe. The heat transfer means may further comprises one or more cooling fins to provide an increased surface area for cooling. The fact that the two cooling zones are thermally linked means that, in use, heat transferred from the cooling zone that heated and styled hair exits from is transferred to the other cooling zone as hair enters the apparatus. This means that cooling zone on the entry side may provide a level of pre-heating before hair passes through the heating zone. This heat transfer means/ "heat bridge" may be further used in combination with a fan or other features described with reference to the second aspect of the invention. The fan, for example, may then further improve the cooling, blowing an air flow over the heat bridge and any projecting fins described below.

According to a second aspect of the invention there is provided a hair styling apparatus comprising a first and a second arm moveable between a closed position in which a contacting surface of the first arm is adjacent a contacting surface of the second arm and an open position in which the contacting surfaces of each arm are spaced apart, whereby the contacting surfaces of each arm have complementary profiles so that, in use, a section of hair is clamped between the contacting surfaces when the arms are in the closed position; a heating zone on at least one of the contacting surfaces for heating the section of hair between the contacting surfaces, two cooling zones on at least one of the contacting surfaces for cooling the section of hair, the cooling zones being positioned either side of the heating zone; and heat transfer means arranged to thermally link the two cooling zones.

The fact that there are two cooling zones, one either side of heating zone, means that, whichever way hair is pulled through the styler, the heat transfer means coupling the two cooling zones will allow transfer of heat between the two cooling zones. Therefore a pre-heating effect is provided by one of the cooling zones whichever way a user chooses to use the stylers, Such apparatus is simple to use. The pair of arms are opened and a section of hair placed between the arms which are then closed. The apparatus is then pulled across the hair to style the hair. In the straightening variant, hair is heated and then cooled to retain a straightened hair style. In the curling variant, this creates a curl in a similar manner to that in which a hair straightener straightens hair by heating and cooling, but instead cooling through a curved cooling zone to set curls into the hair. The cooling zones are preferably immediately either side and adjacent the heating zone on at least one arm and thermally linked by heat transfer means/a thermal conductor to allow heat to be transferred from one cooling zone to the other on an arm. Some arrangements may have the cooling zones on both arms. In use, when hair passes through a cooling zone after heating, heat is drawn out of the hair and absorbed in this cooling zone. To ensure that this 'post heating' cooling zone remains cool, preferably retaining the cooling zone plate temperature to around 50° C., the cooling zones are thermally linked by a heat bridge to transfer heat away from this 'post heating' cooling zone. One further effect of this is to introduce heat into the cooling zone that hair passes through before it reaches the heating zone. Hair is then 'preheated' before entering the heating zone to improve efficiency and allow for faster hair heating and styling. Used in reverse, the 'post-heating' and 'pre-heating' cooling zones functions are swapped.

Other features described herein in relation to the second aspect of the invention apply equally to the other aspects of the invention. The skilled person will appreciate that some features described with reference to the second aspect of the invention are dependent on the provision of heat transfer means. The skilled person will however appreciate that many features are not dependent on such heat transfer means and are more widely applicable to the first, and other aspects of the invention.

In some arrangements the hair styling apparatus may comprise temperature regulation means configured to regulate the temperature of the cooling zone. Such regulation may comprise a temperature sensor thermally coupled to the cooling zone to sense the temperature and a control circuit arranged to control heating or cooling of the cooling zone depending on the sensed temperature such that the temperature in the cooling zone, in use, is regulated to a temperature below that of the heating zone. In some arrangements, it may be preferable to regulate the temperature of the cooling zone to 50° C. (or more), but lower than the temperature in the heating zone of 160° C. or more. It may therefore be preferably to regulate the hair temperature in the cooling zone to between 50° C. and 160° C. In some embodiments it may only be necessary to regulate the temperature to between 90 and 160° C.

The profiles of the contacting surfaces may be configured to create a desired curling effect. For example, the radius of curvature and/or surface area of the curved surface may be designed to provide a desired curling effect.

The or each heating zone may be generally planar or may be curved. Providing a curved heating zone means that a curve introduced in the cooling zones in the opposite direction allows hair to enter and exit the styling apparatus in a generally parallel direction, making the styling apparatus easier to use. Much like the curved cooling zones, on one arm the heating zone may be convex and the other arm have a matching concave shape.

The or each heating zone may be parallel to the direction of opening and closing the arms. Alternatively, the or each heating zone may be angled relative to the direction of opening and closing the arms. Changing the angle of the heating zone changes the curvature of the cooling zone.

The cooling zone on one of the arms may be convex and the contacting surface of the other arm has a matching concave shape. Alternatively, the cooling zone on one of the arms may be concave and the contacting surface of the other arm has a matching convex shape. Where there is a cooling zone on each arm, one may be convex and the other have a matching concave shape. The convex cooling zone may have a radius of between 2 mm and 10 mm, such as 6 mm. Accordingly the matching concave shape on the other arm may be the same or sufficiently similar to provide a snug fit when the arms are closed.

The curvature of the cooling may be more complicated. For example, the cooling zone on one of the arms may have at least two curves and the contacting surface of the other arm has a matching shape. Whatever the curvature, the profiles of the two contacting surfaces are generally parallel to ensure good contact.

The apparatus may further comprise a thermal insulator between the heating zone and the or each cooling zone on at least one of the contacting surfaces. The thermal insulator minimises heat transfer between the heating and cooling zones. One example of a suitable insulator is aerogel.

In the cooling zone, the apparatus may further comprise a phase change material used to absorb heat from the conductive plates or members. Such a phase change material may also be coupled to the heat transfer means to provide a further way of cooling.

According to a further aspect of the invention there is provided a hair styling apparatus comprising a first and a second arm moveable between a closed position in which a contacting surface of the first arm is adjacent a contacting surface of the second arm and an open position in which the contacting surfaces of each arm are spaced apart, whereby the contacting surfaces of each arm have complementary profiles so that, in use, a section of hair is clamped between the contacting surfaces when the arms are in the closed position; a curved heating zone on at least one of the contacting surfaces for heating the section of hair between the contacting surfaces, and a cooling zone on at least one of the contacting surfaces for cooling the section of hair after the section of hair has been heated.

In some arrangements each of the contacting surfaces may comprise two cooling zones, a first of each cooling zones on each contacting surface being aligned and a second of each cooling zones on each arm being aligned so that pair of first cooling zones are adjacent and the pair of second cooling zones are adjacent when the arms are in the closed position. In this way, the styling apparatus may be used in either direction.

In some arrangements the or at least one of the cooling zone is curved whereby, in use, as the hair styling apparatus is moved along the section of hair in a generally linear fashion, the section of hair is curled. This enables the section of hair to be curled. If cooling zones either side of the heater are both curved, then the hair styling appliance may be used in either direction to curl the hair. If only one side is curved, but the other generally planar, then the styling appliance may be used in one direction to curl the hair, and in the other to straighten the hair.

In some arrangements the or at least one of the cooling zones on one of the arms is convex and the contacting surface of the other arm has a matching concave shape. In this way a cooling zone on one arm forms a complimentary shape to a cooling zone on the other arm such that they form a snug fit around the section of hair to be cooled. More effective cooling may then be possible.

At least one of the cooling zones may be curved whereby, in use, as the hair styling apparatus is moved along the section of hair in a generally linear fashion, the section of hair is curled. This provides improved curling capabilities.

In other arrangements at least one of the cooling zones may be generally planar such that in use, when the hair styling apparatus is moved along the section of hair in a generally linear fashion, the section of hair is straightened.

The heat transfer means in any of the aspects of the invention may be a conductive plate, one or more conductive members or heat pipe for example. In some arrangements the heat transfer means may further comprise one or more cooling fins to further cool the cooling zones. Such cooling fins may project into a void between heatable plates in the cooling zone and the housing of the styling appliance. In such an arrangement air may then be blown through this void to further cooling the heat transfer means and/or cooling zones.

Each of the contacting surfaces may comprise a heating zone. These heating zones may be aligned so that the heating zones are adjacent when the arms are in the closed position.

This improves heat transfer into the hair. The or each heating zone may be a heatable plate in thermal contact with a heater in the hair styling apparatus.

Each of the contacting surfaces comprises two cooling zones such that a both arms having two cooling zones. A first of each cooling zones on each contacting surface may be aligned (for example the 'post heating' cooling zones) and a second of each cooling zones (for example the preheating cooling zones) on each arm may be aligned so that pair of first cooling zones are adjacent and the pair of second cooling zones are adjacent when the arms are in the closed position. This improves the cooling of the hair.

In some arrangements at least one of the cooling zones further may further comprise a guide member positioned to guide the cooled section of hair away from the heating zone and cooling zone. In use the hair styling apparatus may be held at an angle to the head such that hair is turned through 90 degrees on exiting the cooling zone such that styled hair is turned in the reverse direction to its path through the cooling zone. To minimise any further cooling as the hair is turned in this reverse direction which may damage the hair style, the guide members may be formed from a material of poor thermal conductivity to minimise cooling.

In some arrangements each of the pair of first cooling zones may comprise a guide member. One of the guide members may be convex and the other may have a matching convex shape such that they fit together snugly. In further arrangements both the first and second pair of cooling zones may have guide members. This way, the styling apparatus can be used in both directions and provide the same effect.

In some arrangements the or each heating zone is generally planar. Furthermore, in some arrangements at least one of the cooling zones on one of the arms is convex and the contacting surface of the other arm has a matching concave shape such that they fit together snugly. Arrangements may have one arm with both cooling zones having a convex shape and the other arm with both cooling zones having a concave shape. In other variants, one arm may have one cooling zone having a convex shape and the other cooling zone having a concave shape. In this latter case, the other arm may then also have one of each shape such that the cooling zones fit together snugly.

In other arrangements, the or each heating zone may be curved. Providing a curved heating zone means that a curve introduced in the cooling zones in the opposite direction allows hair to enter and exit the styling apparatus in a generally parallel direction, making the styling apparatus easier to use. Much like the curved cooling zones, on one arm the heating zone may be convex and the other arm have a matching concave shape.

The above features may also apply to other previously described aspects of the invention.

BRIEF DESCRIPTION OF DRAWINGS

For a better understanding of the invention and to show how it may be carried into effect reference shall now be made, by way of example only, to the accompanying drawings in which.

DETAILED DESCRIPTION OF DRAWINGS

As the skilled person will appreciate, during styling, hair is under tension between the user's head and the styling apparatus. A curl forms in the hair as the styling apparatus is released from the hair. In many of the Figures styled hair is shown exiting the styling apparatus curled—this is purely for illustrative purposes to shown the effect on the hair once it has moved through the styling apparatus. Curls are formed when the hair is no longer under tension.

Figure 1:
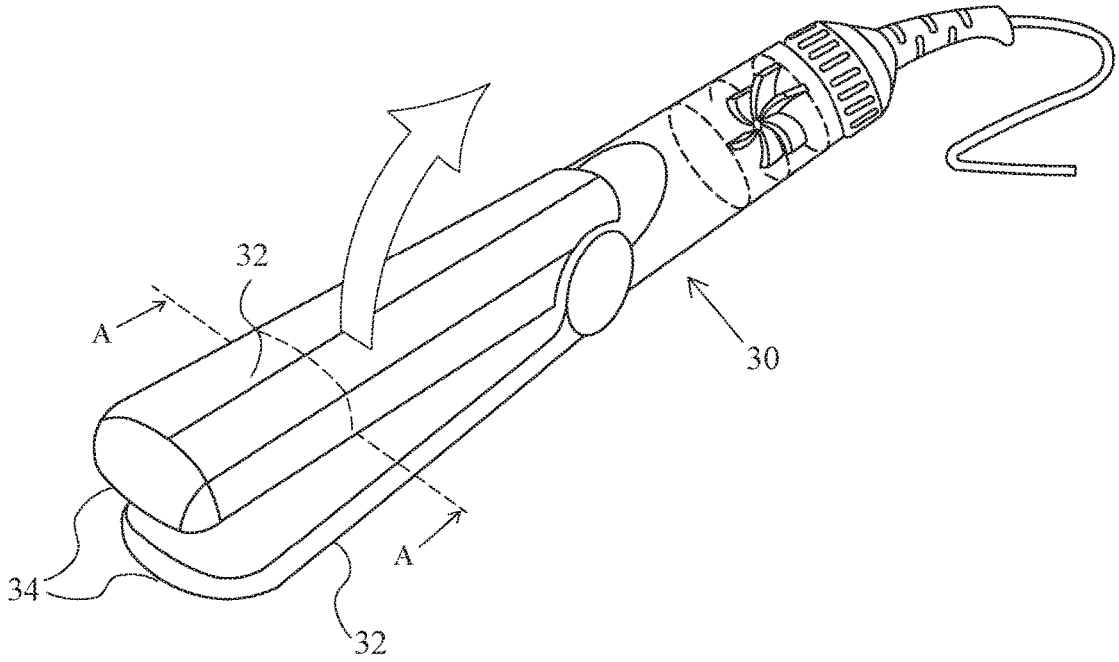
FIG. 1 shows a perspective view of a hair styling apparatus.

FIG. 1 shows a hair styling apparatus comprising an elongate body 30 which forms a handle for a user to grip the apparatus. A pair of arms 32 are attached to the body. The arms are hinged together at one end where they are attached to the body. The arms are moveable between a closed position in which the opposed ends of the arms are adjacent each other and an open position in which the opposed ends of the arms are spaced apart. A heating zone and a cooling zone are formed on each arm as described in more detail with reference to FIGS. 2*a* and 2*b*.

The body houses the components necessary for the operation of the heating and cooling zones. Thus, the body houses a heating system and a cooling system together with a user operated control mechanism for switching the apparatus on and off.

In many of the arrangements, the cooling system may use fluid, e.g. air. This may be delivered by a motor and fan which are housed in the body with conduits through the body and arms to deliver the fluid to the cooling zone. The fan types include axial, radial or centrifugal. Alternatively, the fluid may be delivered by a gas micro pump driven by a motor with the pump and motor housed in the body with conduits through the body and arms to deliver the fluid to the cooling zone. The pump types included diagram pump, gear pump, scroll pump or sliding vain scroll pump. The fluid may be delivered at high pressure to ensure that it cools all the hair. This type of cooling system may be used in any of the arrangements show that use active cooling.

One example of delivering high pressure air is an air blade. This provides a faster rate, more compact and more precise delivery. The micro air blades which deliver the air are integrated into the arms adjacent the heater plates. The micro scroll pump would be housed into the handle. The cooling air would be channelled along small flexible tubes to the micro air blades.

An alternative more conventional technology is a "BLDC fan" which comprises a brushless DC motor and fan. This also delivers good results in a lower risk development.

The rate of cooling the hair with atmospheric air is dependent on airflow volume and the pressure to deliver it, e.g. the higher the pressure, the greater the cooling in a smaller space (cooling zone). Increasing the back pressure is the most effective way to deliver greater volumes of air. Additionally the greater the air pressure the more effectively the air will pass through the hair enclosed by the apparatus which delivers more even cooling through the hair (this is key to reducing "frizz" and "fly aways").

Air flow regulation to the cooling zone will enable the user to vary curl size (diameter). Generally speaking, the more air, the better the hair will retain the curl and hence the curlier the hair. The air flow may be regulated by the user to control the rate of use through the hair. Such regulation may be done by valves controlled.

For ambidextrous apparatus (which have two cooling curved surfaces), air flow regulation might be required to redirect airflow to the required surface. This is because the volume of air will be limited within the geometry of a hand held device. Such regulation might also provide a more cost effective, quieter, energy efficient system.

The cooling system may use a combination of fluid and direct conduction. In such a system, the cooling zone in the arm may be one or more surfaces having a mass. In one arrangement, the fluid (e.g. air) may be used to cool the conductive surface in-between use i.e. between strokes. Such a system may further comprise a phase change material in the cooling zone. Residual heat is built up within the phase change material (latent heat) and can be dissipated between use or strokes, e.g. by using air. Suitable phase change materials include wax and/or water.

Air flow regulation may be used to control the air flow to remove heat built up in conductive (working) surfaces of the product. This may increase the efficiency of styling (curling) or reduce surface temperatures to aid user ergonomics. The system could be implemented by sensing temperature rise or a greater temperature difference between the two cooling zone conductive plates. The air flow regulation may direct air to the hotter side(s) to reduce the temperature. As above, the methods of air flow regulation may include valves.

Alternatively, the cooling system may be delivered by direct conduction. In such a system, the cooling zone in the arm may be one or more surfaces having a mass. The surface(s) have sufficient surface area to dissipate the heat built up to the environment in-between uses/strokes. Such an arrangement is discussed below with reference to FIG. 5.

In any of the arrangements, the heating system may comprise a heater 35 which is mounted in the body and which is arranged in thermal contact with a pair of heatable plates 34. The heatable plates are substantially flat and are arranged on the inside surfaces of the arms in an opposing formation.

In each arrangement, the cooling system is configured to provide rapid cooling of the hair on a curling surface as the hair exits from the heating zone. The curling surface may have a tight radius to enhance curling. Furthermore, it is critical to thermally insulate between the heating zone and the cooling zone. Thermally insulated materials and air boundaries can be used to insulate effectively.

Figure 2A:
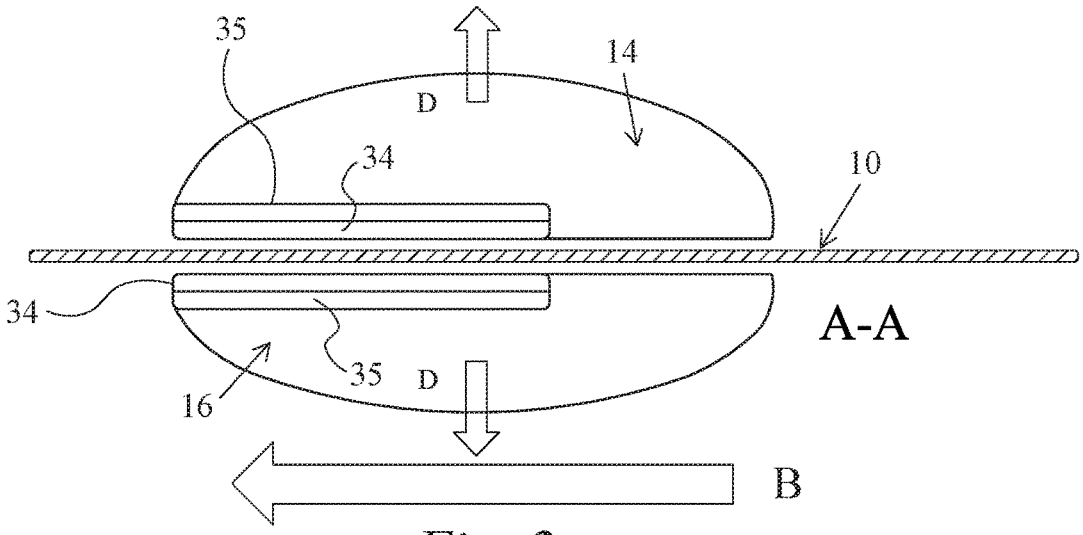
FIG. 2*a* shows a schematic cross-section through the line A-A in FIG. 1 showing planar heating and cooling sections.
Figure 2B:
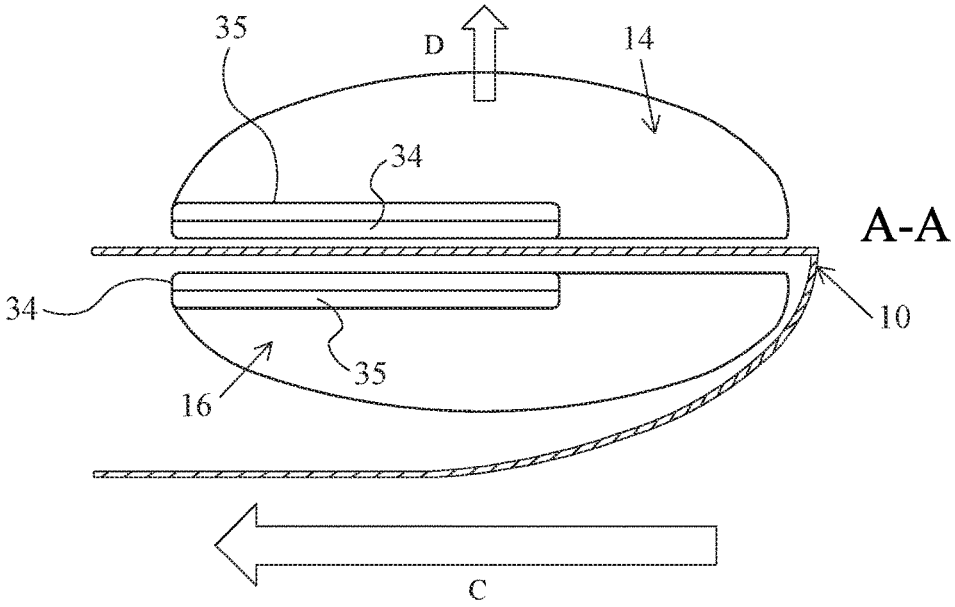
FIG. 2*b* illustrates the cross-section of FIG. 2*a* showing the way in which the device can be used to curl hair.

FIGS. 2*a* and 2*b* show a cross-section through the arms of the hair styling apparatus of FIG. 1 when the arms are in the closed position. The arms are moveable to the open position in the direction of arrows D. Similar arrows have been used throughout the figures to represent the direction of movement of the arms towards the open position. The heating zone 16 comprises a pair of heating plates, one in each arm, and a cooling zone 14 adjacent the heating zone.

FIG. 2*a* shows the device being used as a hair straightener. During the straightening process, the hair 10 is clamped between the hot heatable plates. The apparatus is moved relative to the hair in the direction of arrow B. Similar arrows have been used throughout the figures. Whilst there is relative movement, the hair is kept under tension through the plates so as to mould it into a straightened form. As the hair passes through the heating zone, this prepares the hair for styling. The hair then passes through the cooling zone to set the style, in this case in straightened form. Thus, the hair reduces in temperature immediately after exiting the heaters.

FIG. 2*b* shows the device of FIG. 2*a* being used to curl hair by rotating the hair straightener 180° towards the head prior to pulling the hair 10 through the hot heatable plates in the direction of arrow C. Similar arrows have been used throughout the figures. As with FIG. 2*a*, the hair is heated in the heating zone 16. The curl is made by using the curved outer surface of the device. Whilst on this surface, the hair reduces in temperature immediately after exiting from the heaters. The cooling is essential to ensure that the hair retains the shape of the curling surface. The cooling is enhanced by having a cooling zone 14 to cool the curling surface.

The apparatus is simple to use. The pair of arms are opened and a lock of hair placed between the arms which are then closed. The apparatus is then pulled across the hair to create a curl in a similar manner to that in which a hair straightener straightens hair. The motion is linear. There is no twisting of the hair around the apparatus nor of twisting the apparatus relative to the head.

FIGS. 5 to 8 illustrate various arrangements of the heating and cooling zones to provide an apparatus which curls hair easily. In each case, the heating and cooling zones are housed within one or both of the arms and the outer surface of the housing 20. The arms are shown in the closed position with the hair 10 sandwiched between the two arms. In the arrangements shown in FIGS. 2*a* and 2*b*, the contacting surfaces of the two arms are planar. However, the contacting surfaces to the two arms may be planar in the heating zone but non-planar (i.e. curved) in the cooling zone. The heating zone may also be non-planar. The most effective use of the cooling to create the curl is when the hair is at its hottest point, i.e. when it exits the heater and where the hair is at its tightest radius.

The contacting surfaces of each arm have complementary shapes to ensure that the hair is in contact with both surfaces through both the heating and cooling zones. In other words, the contacting surfaces are generally parallel to each whether regardless of whether they are curved or planar. It is important to ensure that the two surfaces meet together uniformly to provide efficient heat transfer/cooling to the hair. The contacting surfaces may be supported on a resilient suspension in any of the arrangements described, e.g. elastomer supports, to allow some movement of each contacting surface relative to its arm, whereby an even finer tolerance is absorbed. This improves the good surface contact to the hair.

Figure 5:
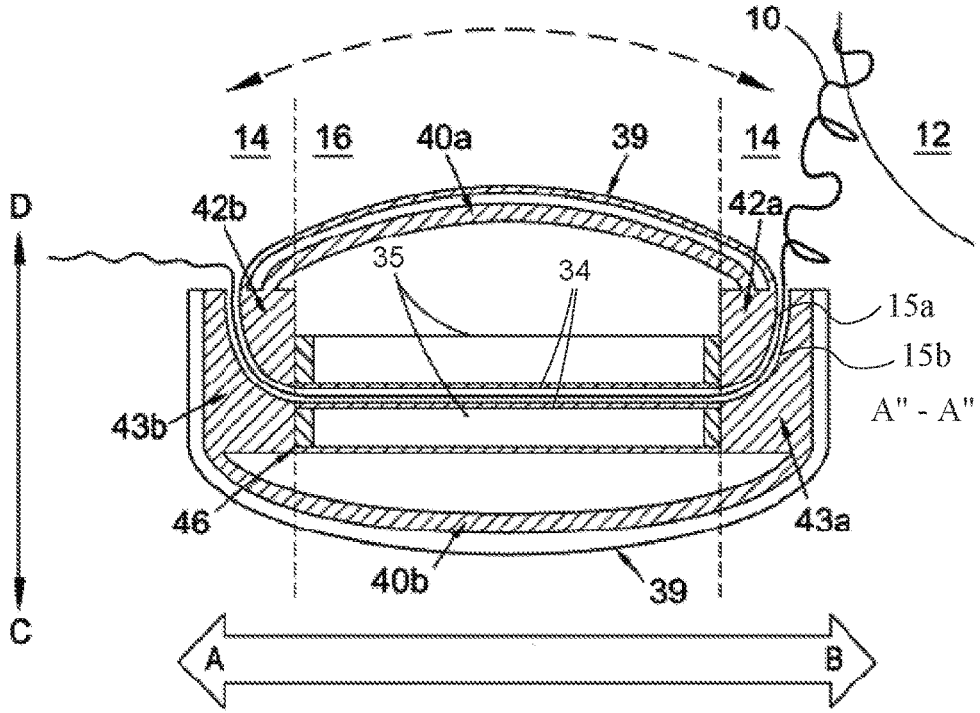
FIG. 5 shows a schematic cross-section through the line A"-A" in FIG. 4 showing a planar heating section and a curved cooling section.

In FIG. 5, one arm has a contacting surface having a generally planar section for the heating zone 16 and a convex section 15*a* for the cooling zone 14. The other arm also has a generally planar section for the heating zone but has a concave section 15*b* for the cooling zone. The curvature of the concave section 15*b* matches that of the convex section 15*a* so that both arms fit together snugly. The planar sections are generally at right angles to the direction D of opening and closing the arms.

Dependant on the cooling method (and the rate at which it cools the hair) differing geometry can be used. For example, the angle at which the heating zone enters the cooling zone can be changed to increase the surface area of the hair in the cooling phase of the system. This can create a longer curved path for the hair to pass around in the cooling zone. The contacting surfaces each have both complementary convex and concave surfaces 15*a*, 15*b*. If the cooling power is greater in this zone, the radius and surface area of the curve that creates the curl may be reduced. Thus the overall product size may also be reduced.

Figure 4:
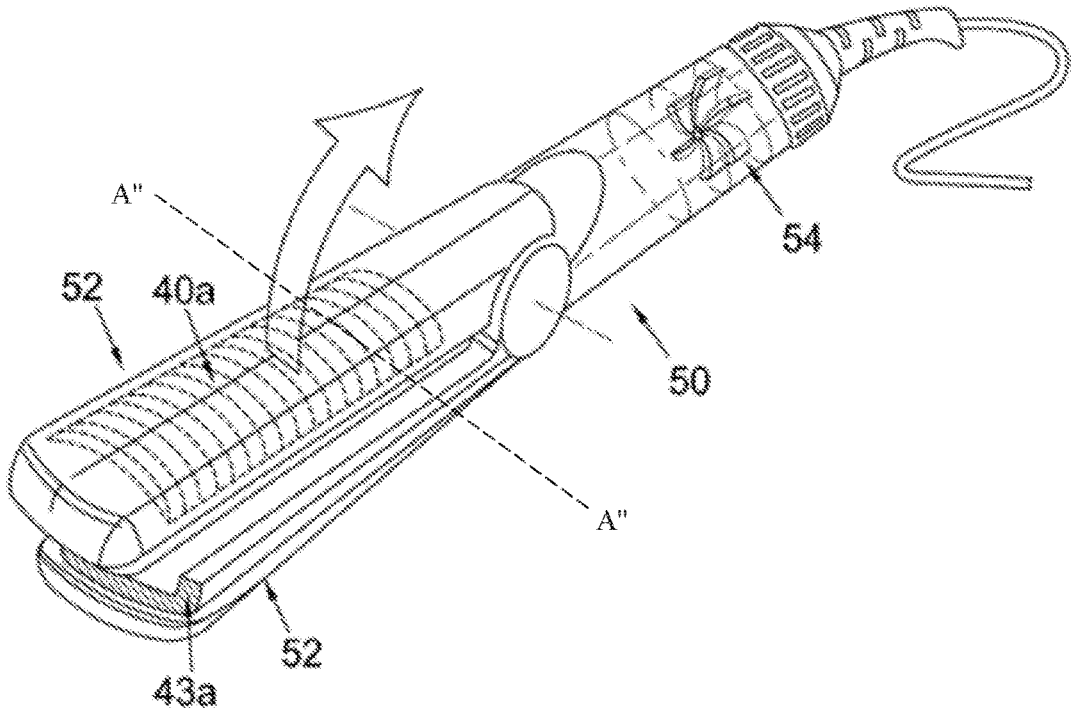
FIG. 4 shows a perspective view of a further alternative hair styling apparatus.

FIGS. 4 and 5 show a hair styling device having an arrangement of heating and cooling zones which ensure that the hair is curled regardless of the direction of use. The apparatus is moved linearly across the hair and the arms open and close in a hinged motion.

The curvature of one cooling zone 14 is reversed relative to the curvature of the other cooling zone 14. Both cooling zones 14 curve towards the outer surface of the same arm to ensure that the same curl direction is produced regardless of the direction of movement of the apparatus. Accordingly, one arm (one of the upper or lower arms) has a cross-section which is smaller than that of the other arm.

A similar change in radius of curvature and surface area ratio can be achieved by using a non-planar heating zone. One arm may have a convex contacting surface in the heating zone and the other arm a concave contacting surface in the heating zone.

Such a non-planar heating zone may be incorporated in any of the arrangements. For implementation of today's off the shelf heater technologies with the ability to create good thermal response, it may be most cost effective to use a planar heater. However, a curved surface may be effective to maximise surface area and the radius of the hair within the cooling zone. A curved heating zone may be formed from a curved aluminium plate for example. One particularly useful and durable embodiment of the heating zone may comprise an aluminium plate bearing a plasma electrolytic oxide (PEO) coating of aluminium oxide. This PEO provides a layer of electrical insulation onto which a heater electrode may then be placed to heat the aluminium plate. The PEO layer also increases the durability of the aluminium allowing it to be shaped (and reshaped if necessary) into the desired curve.

The cooling may be provided by air. The air flow direction can be inwards toward the hair in one arm and outwards from the hair as an exhaust in the other arm. Alternatively, there may be an inlet pointing into the hair and passing through the hair from both arms. In this case, one inlet may provide negative pressure acting as the exhaust.

Figure 3A:
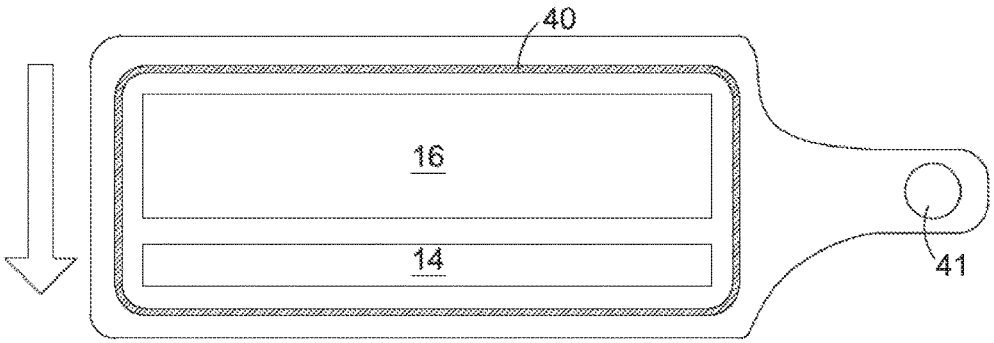
FIG. 3*a* is a plan view of an arm of the device of FIG. 1.
Figure 3B:
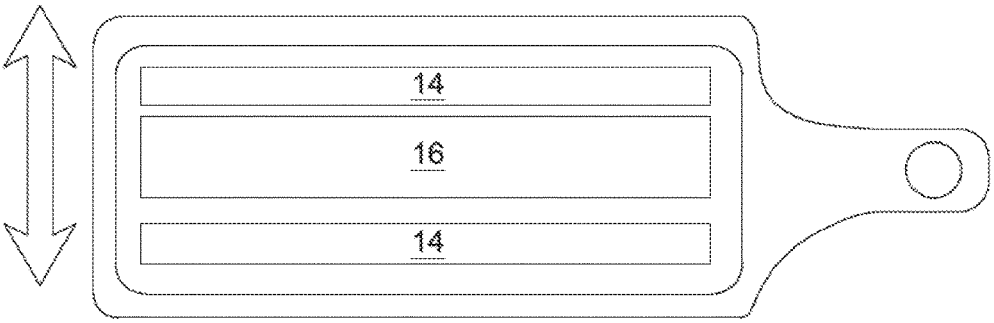
FIG. 3*b* is a plan view of an arm from any one of the devices of FIGS. 5 to 8.

FIGS. 3*a* and 3*b* show that the heating zone 16 and cooling zone(s) 14 extend longitudinally along the length of the arm. The resilient suspension 40 and the hinge 41 are both illustrated schematically. In FIG. 3*a* there is a single cooling zone and thus the apparatus must be used in the direction shown in the arrow to provide curling. In FIG. 3*b*, there are two cooling zones and thus the apparatus is "ambi-dextrous" and may be used in either direction to provide curling.

As previously explained with reference to FIG. 2*b*, users have previously curled hair by rotating the hair straightener 180° towards the head prior to pulling the hair 10 through the hot heatable plates in the direction of arrow C. Such conventional hair straighteners are typically made from a plastic housing, such as rynite. The curved outer surface of the hair straightener is then used to form a curl. Such plastic materials are generally poor thermal conductors and so the heated hair cools slowly. Generally speaking, the better the cooling, the longer the hair retains the shape of the curling surface.

FIG. 4 shows a further arrangement of the hair styling apparatus comprising an elongate body 50 which forms a handle for a user to grip the apparatus. A pair of arms 52 are attached to the body. The arms are hinged together at one end where they are attached to the body. The arms are moveable between a closed position in which the opposed ends of the arms are adjacent each other and an open position in which the opposed ends of the arms are spaced apart. In this arrangement, a heating zone and a cooling zone are formed on each arm, with the cooling zones on either side of the heating zone on one arm thermally coupled together by heat transfer means/thermal conductors (depicted as reference 40*a* on the upper arm and not shown on the lower arm).

In the arrangement of FIG. 4, the cooling system may use a fan, although this is optional and shown here purely for illustrative purposes. Optional fan types that may be used are set out previously in the text referencing FIG. 1. FIGS. 5 to 8 and the supporting text show other cooling system alternatives that may be applied to the hair styling apparatus of FIG. 4.

Figure 6:
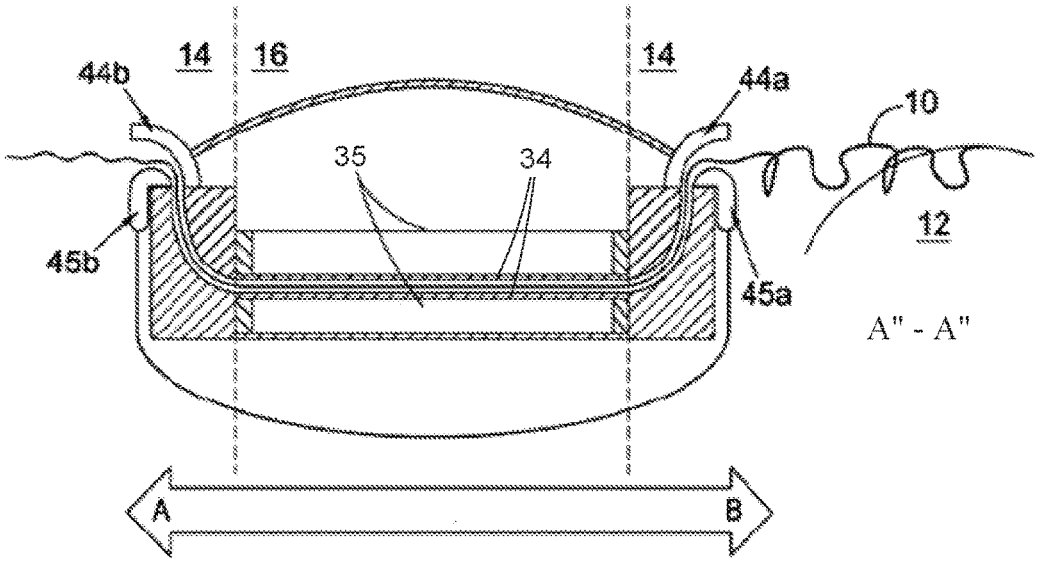
FIG. 6 shows a variant of the cross-section shown in FIG. 5.

FIGS. 5-8 show various arrangements of the heating and cooling zones. As previously described, the most effective use of the cooling to create the curl is when the hair is at its hottest point, i.e. when it exits the heater. Referring to FIG. 5, this shows a cross section through the line A'-A' of FIG. 4 and showing heating and cooling zones arranged to provide an apparatus which curls hair easily. In FIGS. 5 and 6, the styling appliance is shown in use on a user's head 12. The heating and cooling zones are housed within one or both of the arms and the outer surface of the housing 39. As with the illustrations of previous arrangements, the arms are again shown here in the closed position with the hair 10 sandwiched between the two arms. In the arrangement shown in FIG. 5, the contacting surfaces of the two arms are planar in the heating zone 16 and non-planar (i.e. curved) in the cooling zones 14 formed from cooling members 42*a* and 42*b* on one arm and 43*a* and 43*b* on the other arm. These cooling member may be made from pre-formed metal rods (for convex members 42*a*, 42*b*), machined or cast metal for example.

In the arrangements of FIGS. 5-8, the heating and cooling zones are also thermally insulated from one another by insulator 46 in FIG. 5. The thermal insulator minimises heat transfer between the heating and cooling zones. One example of a suitable insulator is aerogel.

The contacting surfaces of each arm in the arrangement in FIG. 5 have complementary shapes to ensure that the hair is in contact with both surfaces through both the heating and cooling zones. This means that the contacting surfaces are generally parallel to each other regardless of whether they are curved or planar. This provides efficient heat transfer/cooling to the hair. The arrangements shown in FIGS. 6 to 8 also have the same complementary shapes on the contacting surfaces of each arm.

In FIG. 5, one arm has a contacting surface having a generally planar section for the heating zone 16 and a convex section 15*a* for the cooling zones formed from cooling members 42*a* and 42*b* positioned either side of the heating zone. The other arm also has a generally planar section for the heating zone but has a concave section 15*b* for the cooling zone 14 formed from cooling members 43*a* and 43*b*. The curvature of the concave sections 15*a* matches that of the convex sections 15*b* so that both arms fit together snugly. The planar sections are generally at right angles to the direction of opening and closing the arms. On each arm, the cooling members 42*a*, 42*b*, 43*a* and 43*b* may extend along each arm along side the heating plates.

We define the "curl factor" as the ratio of the length of straight to curled hair. It has been observed generally speaking, that the smaller the radius 'r' (see FIG. 5) of the curved cooling member, the tighter the curl produced, i.e. the curl factor improves as the radius of the curved cooling members decreases. Moving from a 16 mm radius to a 10 mm improves the curl factor by approximately 20% meaning that tighter curls are produced. Moving from a 16 mm radius to a 6 mm radius curve on the cooling members improves the curl factor by approximately 60%—even tighter curls. Setting the cooling members in the cooling zone to a radius between 2 mm to 10 mm has been observed to provide pleasing curls. One preferred radius 'r' of the curve cooling members is 6 mm. These described radii similarly apply to previous arrangements comprising curved cooling zones.

As set out previously, plastic materials such as rynite are generally poor thermal conductors and so the cooling members may alternative be formed from materials with a better thermal conductivity to improve the cooling of the hair. The cooling members may be formed from metal, such as copper or aluminium and arranged as curved bars, separated from the heatable plates by a thermal insulator such as aerogel. These cooling members provide rapid cooling and curling of the hair on the curved surface compared to plastics. Experimental data shows a curl factor improvement of up to 85% of copper against plastic cooling members. It will be appreciated however that cheaper materials, such as aluminium may be preferred.

In FIG. 5 the cooling members are positioned on both sides of the heating zone such that the direction of use is not critical. This allows the styling apparatus to be used in either direction, making styling easy on each side of the head 12 and allowing for left or right handed use. It some arrangements however this may not be essential and the cooling members may be placed on one side only to reduce both weight and cost of the apparatus. With cooling members present on only one side (i.e. to the left or right of the heating zone as viewed), the hair styling apparatus may be used in one direction to straighten hair, and in the other direction to curl hair.

During use, the cooling members may warm up if there is no mechanism to dissipate the heat transferred from the hair. The longevity of curls is reduced and the diameter of curls increases as the cooling members warm up. The overall curling performance may drop significantly should the cooling members rise in temperature from 30 to 70° C. FIG. 5 shows one arrangement of the apparatus for addressing this. Experiments have shown that limiting the temperature of the cooling members to around 50° C. leads to effective styling and curl longevity. However, it will be appreciated that initially, at turn on, these cooling members may be at a much lower temperature. In some arrangements the cooling members may also be heated, to around 50° C. for example, in order to provide consistent cooling to when the apparatus is fully heated and in use. This allows for a consistent curl style to be produced.

In FIG. 5, thermal conductors 40*a* and 40*b* provide a heat bridge between the respective cooling members on either side of each arm to transfer heat between the cooling members. This heat bridge may take the form of a metal plate or series of pipes/bar acting as a conductive member within one or both arms. The heat bridge (heat sink) may be made from a good thermal conductor—preferably a metal such as aluminium. In some arrangements the heat bridge and cooling members in one arm may be manufactured as a single unit. Variants of the heat bridge may use a heat pipe for heat transfer or pumped fluid. The heat pipe may be of at least 5 cm in length in order to work effectively.

Figure 7:
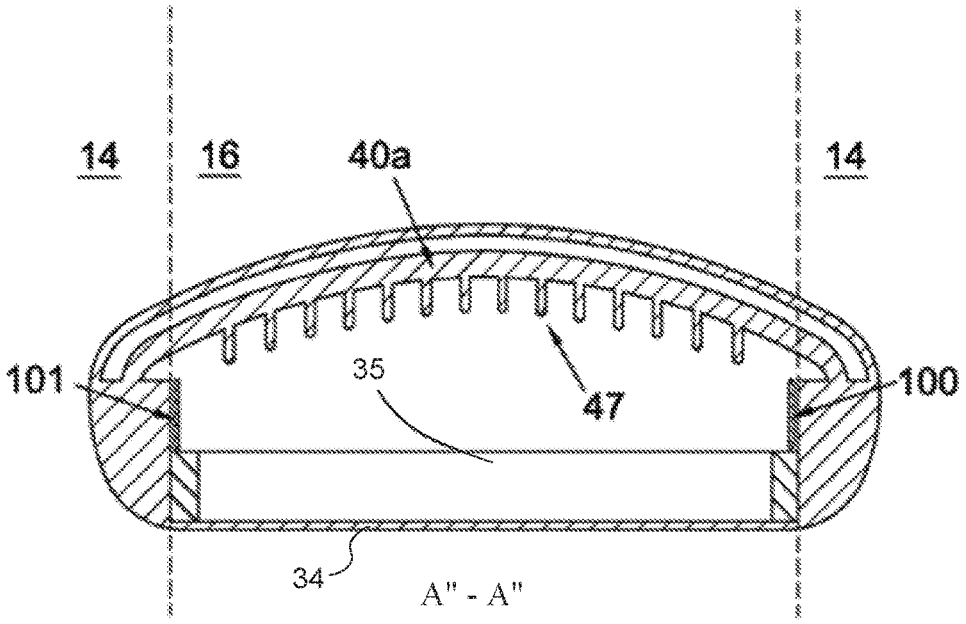
FIG. 7 shows a variant of the cooling means through one arm of the device of FIG. 4.

FIG. 7 depicts a variant of the FIG. 5 arrangement. Only the upper arm is shown but the same technique may be implemented on the lower arm as well. In FIG. 7, cooling fins 47 extend into the void to provide a heat sink/radiator like arrangement by increasing the surface area. Referring to FIG. 4, the heat bridge/heat sink 40*a* is shown in dotted lines (denoting that it is present inside the outer plastic casing. Combining the heat bridge/heat sink with the fan 54 in FIG. 4 enables air to be blown through the cooling fins to improve the cooling of the heat sink and the cooling members. Driving air through the void and fins of the heat bridge/heat sink means the fan can generate less air pressure than through arrangements using tubes or holes in the cooling members. This means the fan size may be reduced and/or a lower revolution speed used leading to a quieter fan. To improve efficiency further, a further thermal insulator may be included in a portion of the void between the heatable plate and heat bridge/heat sink. In this arrangement it may not be necessary to provide a thermal link between cooling members on either side of one arm—each may be cooled independently by air flow through the cooling fins.

In FIGS. 5 and 6, hair on the head of user 12 is to be styled. To style hair, a user puts hair in the styling apparatus then rotates the hair styling apparatus of FIG. 5 by 90° towards the head prior to pulling the hair 10 in a linear fashion through the hot heatable plate (turning the apparatus 90° is less counter-intuitive to a user than turning through) 180°. By pulling hair through, such that the apparatus moves along the hair in the direction of arrow A in FIG. 5 (the apparatus itself may be moved in direction C or D relative to the head of the user 12), hair is first pulled over cooling members 42*b* and 43*b* (which now provide pre-heating) and then through the heating zone 16. As the hair 10 is pulled over cooling members 42*a* and 43*a*, the hair is rapidly cooled and curled.

Heat transfer from the hair to the cooling members 42*a* and 43*a* is transferred via the respective thermal conductor to respective cooling members 42*b* and 43*b*. This leads to cooling members 42*b* and 43*b* heating up as a result of the heat transfer. Elements 42*b* and 43*b* then effectively act as pre-heating elements, returning heat extracted from the cooling and curled hair back into sections of hair still to be heating and styled.

Operated in reverse, with hair pulled through in the direction of arrow B, hair is first pulled over cooling members 42*a* and 43*a* (which now provide pre-heating) and then through the heating zone 16. As the hair 10 is pulled over cooling members 42*b* and 43*b*, the hair is rapidly cooled and curled. Heat transfer from the hair to the cooling members 42*b* and 43*b* is transferred via the respective thermal conductor to respective cooling members 42*a* and 43*a*.

In FIG. 5, as styled hair exits the right hand (as viewed) cooling zone 14 formed from cooling members 42*a* and 43*a*, hair is turned through a further 90 degrees (or more) over the edge of cooling member 43*a*. This change of direction may be in the opposite direction to the previous curling (the hair may take an "S" shaped path. Any subsequent cooling of the hair during this second change in direction may lead to the quality of the curled hair style being comprised—the curled and cooled hair has now been turned in a second direction following heating and cooling which may affect the overall quality and appearance of the curl. FIG. 6 illustrates one way of addressing this problem.

In FIG. 6, curl guides 44*a*, 44*b*, 45*a*, 45*b* are positioned on the outer edges of the cooling members. These guides are generally formed of a material with poor thermal conductivity, which may be the same material as the hair styler housing, such as rynite.

The guides are arranged to guide the hair through a further 90 degree turn, but in the opposite direction to the cooling members. The guides may be separate components or an integral parts of the hair styler housing. In this way, hair exits the styling apparatus in the same direction as which it entered, meaning that the hair styling apparatus can be pulled in a generally linear fashion along the hair, without holding the apparatus at 90 degrees to the head. In FIG. 6 for example, it can be seen that the styling appliance, when pulled in direction A to style hair on the side of user's head 12, does not need to be held at 90 degrees to the head 12.

Forming the guides from a material of poor thermal conductivity compared to that used on the cooling members reduces heat loss from the curled hair as it passes over the guides. This reduces impact to the styled hair as it turns in the opposite direction on exiting the cooling zone.

The guides have further benefits, helping to protect the cooling members from accidental scratching, denting and minimising any heat transfer when the stylers are placed on a surface after use.

Figure 10:
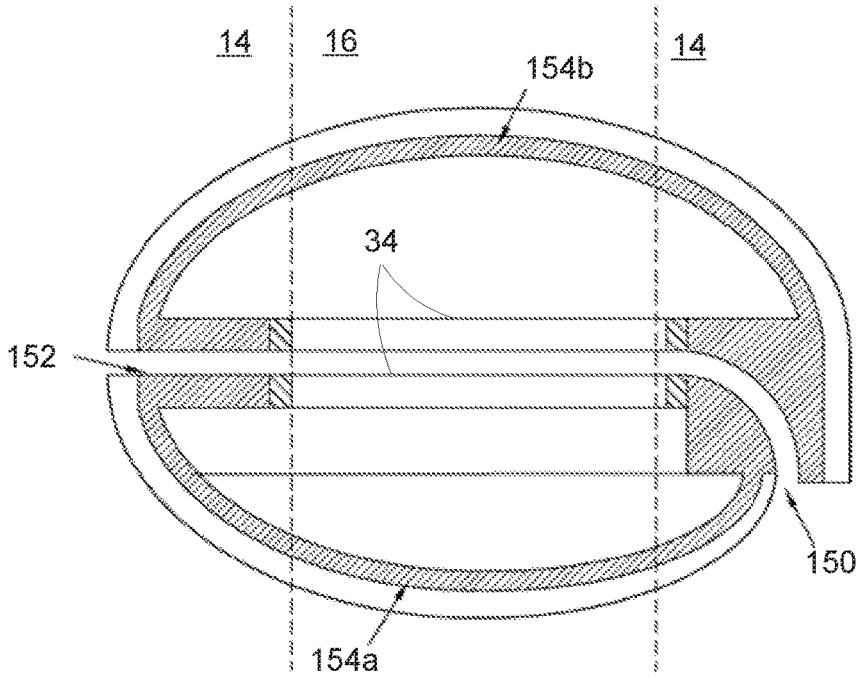
FIG. 10 shows a further variation of the device for straightening and curling hair.

In another variant, such as that shown in FIG. 10, the styling apparatus again has cooling zones 14 and heating zone 16, but here the apparatus may have a curved cooling zone 150 on one side, and a flat cooling zone 152 on the other. In this way, hair may be heated, cooled and curled using the styling apparatus in one direction, then heated, cooled and straightened by using the styling apparatus in the opposite direction. A heat bridge 154*a*, 154*b* may again be used in this arrangement.

Figure 11:
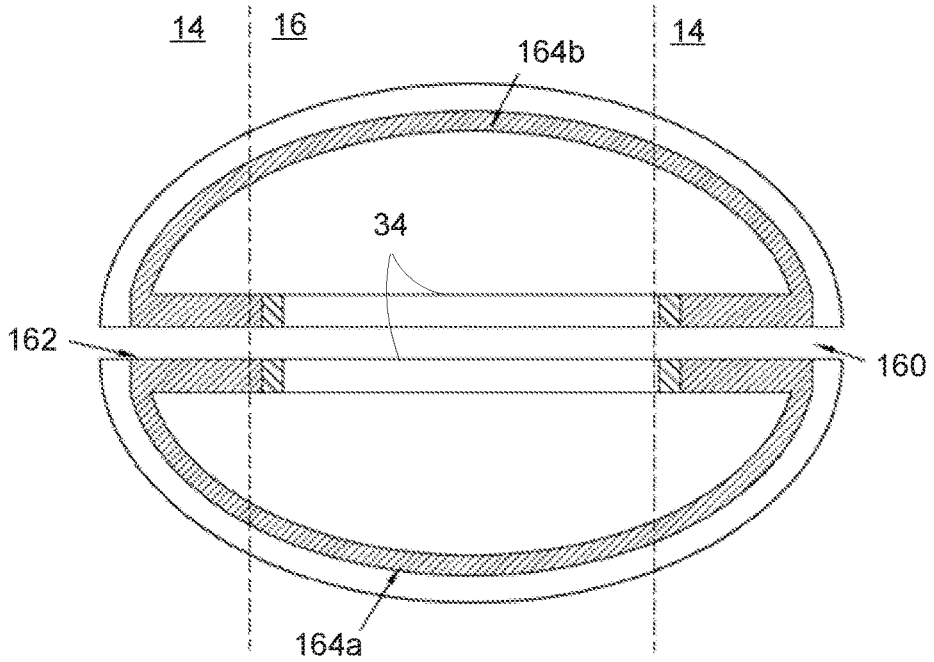
FIG. 11 shows a further variation of the device used for straightening hair.

A further variant is shown in FIG. 11. The arrangement of FIG. 11 is used for straightening hair. Here both cooling zones 160, 162 are generally planar (it will however be appreciated that only one side may have cooling zones, and the other side may have no cooling zone if the apparatus is to be used in one direction only). In an arrangement with dual zones, either side of the heating zone, the heat bridge 164*a*, 164*b* may again be used to thermally link the cooling zones and provide for improved cooling. As with the other arrangements described herein, again features such as cooling fins, active cooling mechanisms (fluid cooling and the like), and/or a fan may be used in order to improve the cooling. The cooling zones may also include heating, to a temperature below that of the heating zones, in order to provide uniform cooling of hair.

Figure 8:
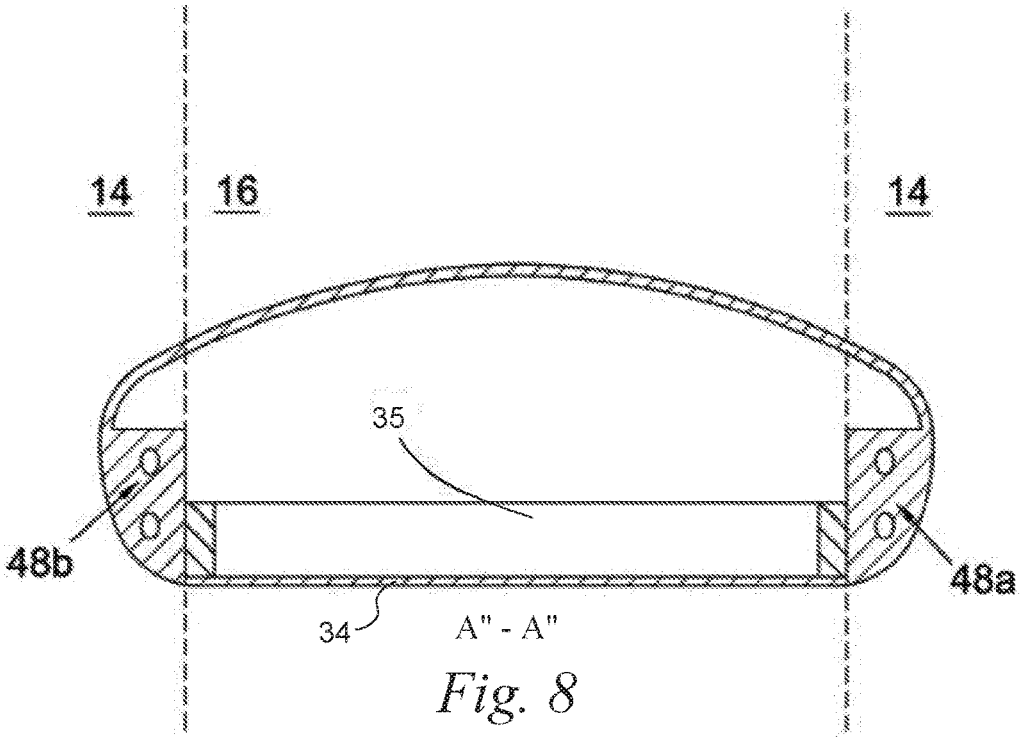
FIG. 8 shows a further variant of the cooling means through one arm of the device of FIG. 4.

FIG. 8 shows a further arrangement of the cooling members through one arm of device of FIG. 5. In this arrangement the cooling members include one or more conduits within the cooling members in which a fluid (gas or liquid such as water) can be pumped. The fluid may be delivered at a high pressure to ensure that it provides effective cooling and rapid transfer of the heat. Such an arrangement may include members of the other arrangements, such as the heat sink/heat bridge of FIGS. 5 and 7 to provide means for cooling the pumped fluid.

As set out for the previous arrangements, a phase change material may also be used to draw heat out of the cooling members in FIGS. 5 to 8. Such a material may replace or be connected to the heat bridge 40*a* in the cooling zone. Residual heat is built up within the phase change material (latent heat) and can be dissipated between use or strokes, e.g. by using air. Suitable phase change materials include wax and/or water.

Figure 9:
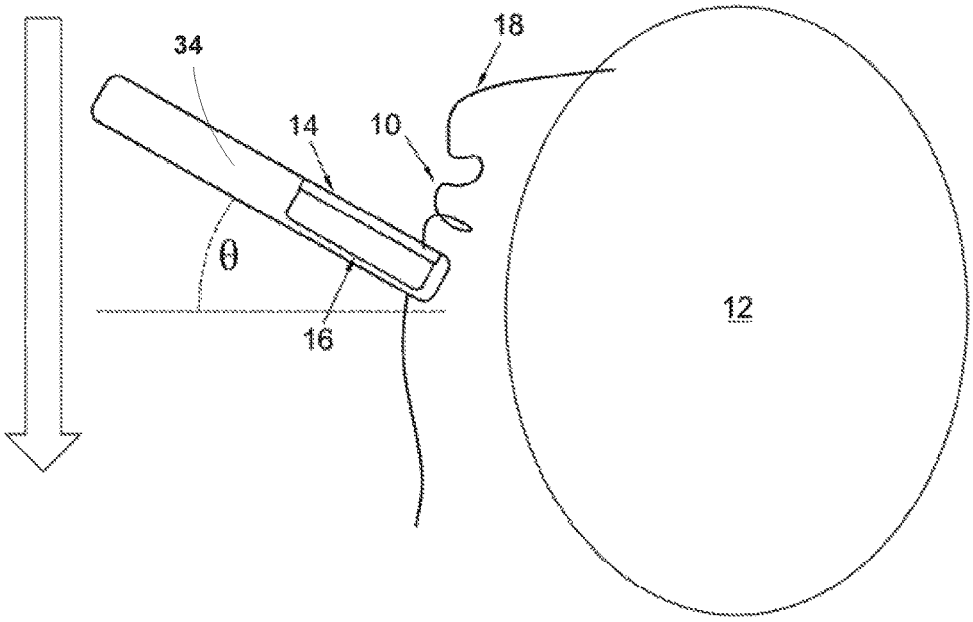
FIG. 9 is a schematic illustration of one of the apparatus angled adjacent a user's head.

To control the direction that a curl forms in, in use, a user may move the hair styling apparatus along the hair to be styled at an angle offset (angle θ in FIG. 14) to the direction of movement. As shown in FIG. 9, the apparatus is angled so that the one of the heatable plate, furthest away from the hinge end, leads the other end of the heatable plate. The curl direction is reversed by changing the angle offset so that the end of the heater closest to the hinge end leads the end further away. Such a technique is useful to ensure the hair style is balanced on either side of the head and is applicable to all the arrangements described.

In all of the arrangements described above, direct contact between two parallel plates is critical to achieve efficient heat transfer to the hair. Achieving uniform heat up of the entire hair section is critical for curl retention. The efficiency of the heat transfer created by two heater plates creates a flow of heat energy into the hair. By the addition of responsive temperature of control of this surface, the temperature of hair within the apparatus is maintained with the movement of the plates along a hairs section. The curl style (shape) of the hair is created when the hair cools whilst it is maintained in a shape.

By contrast, heating hair from a single surface (or side) is less efficient and relies on the heat transferring through the hair. However, hair is a good thermal insulator and this process takes time. One disadvantage is that such an apparatus cannot be simply moved along the hair. Furthermore, there is a temperature difference across the section of hair within the apparatus and this means that individual hairs within the section may curl different amounts or behave differently. This may create fly always and may additionally cause poor longevity of style. This is because that if the individual hairs are not behaving uniformly, the tighter curling fibres may end up supporting the weight of others and hence drop out more quickly.

All of the arrangements described above also achieve even cooling through all the hairs making up a section. This is critical to preventing uneven curl retention to individual hair fibres creating fuzzy hair. Without this cooling, the user has to control the rate at which the apparatus is used.

In each arrangement, the hair is preferably heated to a temperature above 160° C. in the heating zone. The hair is preferably reduced in temperature in the cooling zone(s) to a temperature which is less than that in the heater zone. There is little style advantage in cooling the hair to less then 90° C. Accordingly, the hair is preferably cooled to a temperature between 90° C. and 160° C. This may be achieved by limiting the temperature of the cooling members in arrangements shown in FIGS. 4 to 10 to a maximum of 50° C. Generally speaking however, the cooler the hair becomes in the cooling zone the more effectively the hair retain the shape it is held in though the cooling zone. The heating and cooling is preferably stable at the preferred temperature.

To retain a stable temperature in the cooling zones, the cooling zone following the heating zone (i.e. the cooling zone in which hair exits the appliance), may be temperature regulated, which may involve heating the cooling zone to a temperature less than that used in the heating zone, in particular when the apparatus is started from cold. Both cooling zones may also be temperature regulated. In this way, the temperature of the cooling zone(s) may be held stable such that consistent styling curling is possible. The implemented cooling system may then actively switch between cooling the cooling zone and heating the cooling zone in order to retain a stable temperature, cooler than that of the heating zone. FIGS. 7 and 8 show one arrangement of introducing heater elements into the cooling zones. In FIG. 7 heater elements 100, 101 may be coupled to the cooling members (should the cooling members be metal, the skilled person would appreciated the heater elements would need to be electrically insulated). In FIG. 8, similar heater elements may be used, or alternatively, a heated fluid may be routed through the conduits. It will be appreciated that such heating in the cooling zones is entirely optional and many arrangements may choose not to provide such heating.

By maintaining a constant stable heater input temperature and a continuously flow of air cooling the hair the user is able to create tighter or looser curls by altering the rate at which they draw the product through the hair. Generally, the faster the movement, the straighter the hair and the slower the movement of the apparatus, the curlier the hair. The rate of movement is limited by the heater input temperature. It is also critical to cool the hair all the way though the section to achieve this. For curling, a suitable rate may be between 10 and 30 mm/s.

The nature of the curl generated will also depend on the amount of hair input and the nature of the hair. Inputting a section of straight hair may create one or more locks of curls dependant on the size of the section and the tightness of the curls created. This is because of the natural relationship that curly hair displays, i.e. to form locks of curls. Naturally curly hair can be curled to the desired size of curl in the same way straight hair can be curled.

As described above, the most effective place to cool the hair (to retain a curved shape) is at its hottest point when it exits the heater and its curvature is greatest. Furthermore, as described above the most effective cooling is achieved in arrangements directing air onto the hair by creating the optimal balance between the air's pressure, volume flow rate and aperture size. Other effects can be created by altering the design of the apparatus. For example, "shine" and soft feeling hair could be created by directing the air direction in a downward direction, i.e., helping to close the cuticle. Air flowing in the opposite direction could have a detrimental effect on the hairs' shine. In other arrangements, such as those in FIGS. 5 to 9, ensuring that the hair is only cooled and curled in one direction (i.e. there is no further cooling and curling in a different direction) also leads to improved curls.

The addition of negative ions in the air stream (created in any known manner, e.g. by a high voltage needle could help reduce static charge built up in the hair due to motion of use. On a small scale it is thought that the negative ions will help to close the cuticles of the individual hair fibres creating additional shine.

No doubt many other effective alternatives will occur to the skilled person. It will be understood that the invention is not limited to the described embodiments and encompasses modifications apparent to those skilled in the art lying within the spirit and scope of the claims appended hereto.

Through out the description and claims of this specification, the words "comprise" and "contain" and variations of the words, for example "comprising" and "comprise", means "including but not limited to, and is not intended to (and does not) exclude other moieties, additives, components, integers or steps.

Throughout the description and claims, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example, of the invention are to be understood to be applicable to any other aspect, embodiment or example described herein unless incompatible therewith.

The invention claimed is:

1. A hair styling apparatus comprising a first arm and a second arm, the first and second arms being elongate in length such that each of the first and second arms has a longitudinal axis along its length and being coupled together at one end thereof to allow the first and second arms to be moveable between a closed position in which a first hair contacting surface of the first arm is adjacent a second hair contacting surface of the second arm and an open position in which the first and second hair contacting surfaces are spaced apart;

wherein the first and second hair contacting surfaces have complementary profiles so that, in use, a section of hair is clamped between the first and second hair contacting surfaces when the first and second arms are in the closed position;

wherein the first arm comprises a first heatable plate and a first heater for heating the first heatable plate, wherein an outer surface of the first heatable plate forms a first part of said first hair contacting surface;

wherein the second arm comprises a second heatable plate and a second heater for heating the second heatable plate, wherein an outer surface of the second heatable plate forms a first part of said second hair contacting surface;

wherein the first heatable plate is positioned on the first arm and the second heatable plate is positioned on the second arm so that the first and second heatable plates are adjacent each other when the first and second arms are in the closed position for heating the section of hair;

wherein the first arm further comprises first and second cooling members for cooling the section of hair, the first cooling member having a surface that forms a second part of said first hair contacting surface and the second cooling member having a surface that forms a third part of said first hair contacting surface, the first and second cooling members being positioned on the first arm so that the first part of said first hair contacting surface is positioned between the second and third parts of the first hair contacting surface in a direction transverse to the longitudinal axis of the first arm; and wherein the first arm further comprises a heat bridge that extends within the first arm behind the first heater and between the first and second cooling members, and that is formed of a material that is arranged to allow heat gained by the first cooling member to be transferred through the heat bridge to the second cooling member.

2. A hair styling apparatus as claimed in claim 1, wherein at least one of the second and third parts of the first hair contacting surface is curved whereby, in use, as the hair styling apparatus is moved along the section of hair in a generally linear fashion, the section of hair is curled.

3. A hair styling apparatus as claimed in claim 1, wherein at least one of the second and third parts of the first hair contacting surface is planar.

4. A hair styling apparatus according to claim 1, wherein the second arm comprises third and fourth cooling members, wherein the first cooling member is positioned on the first arm and the third cooling member is positioned on the second arm so that the first and third cooling members are adjacent each other when the first and second arms are in the closed position and wherein the second cooling member is positioned on the first arm and the fourth cooling member is positioned on the second arm so that the second and fourth cooling members are adjacent each other when the first and second arms are in the closed position.

5. A hair styling apparatus according to claim 4, wherein at least one of the first, second, third and fourth cooling members further comprises a guide member positioned to guide the cooled section of hair into a curl.

6. A hair styling apparatus according to claim 5, wherein said first cooling member comprises a first guide member and said third cooling member comprises a second guide member, and wherein the first guide member has a convex surface and the second guide member has a complementary concave surface.

7. A hair styling apparatus according to claim 1, wherein the heat bridge comprises a conductive plate or rod.

8. A hair styling apparatus according to claim 1, wherein the heat bridge comprises a heat pipe.

9. A hair styling apparatus according to claim 1, wherein said heat bridge comprises one or more cooling fins.

10. A hair styling apparatus according to claim 1, wherein the first part of said first hair contacting surface and the first part of said second hair contacting surfaces are planar and the second part of the first hair contacting surface is convex and the second hair contacting surface has a complimentary concave shape at a position corresponding to the second part of the first hair contacting surface.

11. A hair styling apparatus according to claim 10, wherein the convex second part of the first hair contacting surface has a radius of between 2 mm and 10 mm.

12. A hair styling apparatus according to claim 1, wherein the first part of the first hair contacting surface is curved.

13. A hair styling apparatus according to claim 1, wherein one or both of the first and second cooling members extend along at least part of the longitudinal axis of the first arm.

14. A hair styling apparatus according to claim 1, wherein the first and second cooling members are conductive.

15. A hair styling apparatus according to claim 1, wherein the first and second hair contacting surfaces are supported on a resilient suspension to allow movement between the first hair contacting surface and the first arm and to allow movement between the second hair contacting surface and the second arm.

16. A hair styling apparatus according to claim 1, wherein the first heatable plate extends along at least part of the length of the longitudinal axis of the first arm and the second heatable plate extends along at least part of the length of the longitudinal axis of the second arm.

17. A hair styling apparatus according to claim 1, wherein the first and second heatable plates are configured to heat the hair to above 160° C.

18. A hair styling apparatus according to claim 17, wherein the first or second cooling member is configured to bring the hair temperature to between 90° C. and 160° C. after the hair has been heated by the first and second heatable plates.

19. A hair styling apparatus according to claim 1, further comprising a thermal insulator between the first heater and the first cooling member and a thermal insulator between the first heater and the second cooling member.

* * * * *